US006044819A

United States Patent [19]

Rivers et al.

[11] Patent Number: 6,044,819

[45] Date of Patent: Apr. 4, 2000

[54] PISTONS AND CYLINDERS MADE OF CARBON-CARBON COMPOSITE MATERIALS

[75] Inventors: H. Kevin Rivers, Hampton; Philip O. Ransone, Gloucester; G. Burton Northam, Carrollton, all of Va.; Francis A. Schwind, Fort Worth, Tex.

[73] Assignee: The United States of America as represented by the Administrator of the National Aeronautics and Space Administration, Washington, D.C.

[21] Appl. No.: 08/808,290

[22] Filed: Feb. 28, 1997

Related U.S. Application Data

[60] Provisional application No. 60/012,933, Mar. 6, 1996.

[51] Int. Cl.[7] ..... F02F 75/06

[52] U.S. Cl. ..... 123/193.1; 123/193.6; 123/193.4; 123/193.2

[58] Field of Search ..... 123/193.6, 193.2, 123/195 R, 193.1, 193.4, 193.3; 92/223, 212

[56] References Cited

U.S. PATENT DOCUMENTS

| | | | |
|---|---|---|---|
| 4,629,200 | 12/1986 | Ruddy | 277/216 |
| 4,683,809 | 8/1987 | Taylor . | |
| 4,736,676 | 4/1988 | Taylor . | |
| 4,751,871 | 6/1988 | Burghardt et al. | 92/212 |
| 4,909,133 | 3/1990 | Taylor . | |
| 5,083,537 | 1/1992 | Onofrio et al. . | |
| 5,370,087 | 12/1994 | Guimond et al. . | |
| 5,469,777 | 11/1995 | Rao et al. | 92/223 |
| 5,687,634 | 11/1997 | Ransone | 123/195 R |
| 5,769,046 | 6/1998 | Ransone | 123/193.2 |

*Primary Examiner*—Marguerite McMahon
*Attorney, Agent, or Firm*—Kurt G. Hammerle; George F. Helfrich

[57] ABSTRACT

An improved reciprocating internal combustion engine has a plurality of engine pistons, which are fabricated from carbon-carbon composite materials, in operative association with an engine cylinder block, or an engine cylinder tube, or an engine cylinder jug, all of which are also fabricated from carbon-carbon composite materials.

9 Claims, 6 Drawing Sheets

PISTONS AND CYLINDERS MADE OF CARBON-CARBON COMPOSITE MATERIALS

CLAIM OF BENEFIT OF PROVISIONAL APPLICATION

Pursuant to 35 U.S.C. §119, the benefit of priority from provisional application 60/012,933, with a filing date of Mar. 6, 1996, is claimed for this non-provisional application.

ORIGIN OF THE INVENTION

This invention was jointly made by NASA employees and an employee of Carbon-Carbon Advanced Technology, Inc. and may be manufactured and used by or for the Government for governmental purposes without the payment of any royalties thereon or therefor.

BACKGROUND OF THE INVENTION

1. Field of the Invention

This invention relates to a machine comprising lightweight, high strength pistons with or without piston rings, operating in a reciprocating internal combustion engine cylinder block or liner, and more specifically to a machine using pistons and cylinder blocks or liners fabricated from carbon-carbon composite materials.

2. Description of the Related Art

Internal combustion reciprocating engines used for aerospace, military, and transportation applications must be lightweight and capable of operating at elevated temperatures and pressures. Under the current state-of-the-art, the relatively high temperatures and pressures associated with operation of a reciprocating internal combustion engine necessitates pistons made of either aluminum alloys, cast-iron, and/or steel. However, engine pistons manufactured of steel and/or aluminum alloys are heavy which adds weight to the reciprocating mass of diesel and gasoline engines. Steel and aluminum alloy pistons are also highly thermally conductive; hence, a significant heat transfer, i.e. heat loss, through the cylinder wall results. In diesel engines this "through-the-wall" heat loss reduces engine efficiency.

Cylinder blocks for reciprocating internal combustion engines in automobiles typically have been made of cast iron because of the need for high mechanical strength. Use of cast iron, however, adds weight to the engine and results in lower fuel economy. In an effort to reduce engine weight, various light-weight alloys such as aluminum alloy have been used to fabricate the cylinder block. Typically, the engine block mass is made of aluminum alloy and a thin-walled cast iron sleeve is inserted to line the cylinder bore(s). Alloys of aluminum are lighter than cast iron, however, they have a lower mechanical strength which creates undesirable vibration. In addition, aluminum alloys inherently possess lower temperature resistance and a higher coefficient of thermal expansion (CTE) than cast iron which means that differential thermal expansion between aluminum alloys and cast iron must be taken into account in design.

The inherently high coefficient of thermal expansion of aluminum alloys necessitates larger clearances between an aluminum alloy piston and a cast iron cylinder wall, to avoid piston scuffing and/or sizing which could occur as an aluminum alloy piston expands during high temperature engine operation. In order to seal the clearance, or gap, between an aluminum alloy piston and a cast iron cylinder wall, piston rings are required. Metallic and ceramic piston rings commonly are used in conjunction with steel and/or aluminum alloy pistons. Typically, ceramic rings replace metal rings when extreme operating temperatures so dictate. Ceramic rings, however, become brittle during extensive operation at extreme temperatures and are unreliable.

At operating temperatures above 300 degrees Celsius (C), the mechanical strength of aluminum alloy pistons decreases dramatically. The uppermost compression ring cannot be located too close to the crown because the reduced mechanical strength will result in deformation of the piston above the top ring due to forces exerted by ring friction. The need for positioning the top ring further from the crown increases the crevice volume between the piston and cylinder wall which, by necessity, must exist to accommodate thermal expansion of the piston. A further disadvantage of larger gaps between aluminum alloy pistons and the cylinder wall includes "piston rocking" in the cylinder bore which increases engine noise and necessitates additional piston mass as longer skirts are needed. Large amounts of lubricants are also required to control the wear rates of the piston and cylinder wall.

SUMMARY OF THE INVENTION

Accordingly an object of this invention is to reduce the weight of an internal combustion reciprocating engine with the use of carbon-carbon composite pistons in conjunction with carbon-carbon composite cylinder blocks or liners.

It is another object of the present invention to minimize or eliminate the thermal distortion in the piston-to-cylinder system, to minimize the clearance between the piston and cylinder wall, so as to promote quieter operation.

It is yet another object of the present invention to minimize or eliminate the thermal distortion in the piston-to-cylinder system, to minimize the clearance between the piston and cylinder wall, so as to provide for potential ringless operation.

It is still another object of the present invention to minimize or eliminate the thermal distortion in the piston-cylinder system, to minimize the clearance between the piston and cylinder wall, so as to reduce hydrocarbon emissions into the atmosphere.

It is a further object of the present invention to minimize or eliminate the thermal distortion in the piston-cylinder system, to minimize the clearance between the piston and cylinder wall, so as to improve engine efficiency.

Another object of the present invention is to provide an internal combustion reciprocating engine which operates with self-lubricating pistons.

A further object of the present invention is to provide an internal combustion reciprocating engine with piston rings which provide better sealing thus reducing "blow by" and oil consumption.

According to the present invention, the foregoing and additional objects are attained by combining a carbon-carbon composite piston with a carbon-carbon cylinder block or liner, and, if desired, carbon-carbon composite or graphite piston rings.

Carbon-carbon composite cylinder blocks and liners used in conjunction with carbon-carbon composite pistons according to the present invention represents a significant improvement over the prior art. While performing the same function as a cast iron or aluminum alloy cylinder block, a carbon-carbon composite cylinder block or liner weighs less and has negligible CTE which creates higher dimensional stability at normal operating temperatures, i.e. minimal expansion of the carbon-carbon composite material.

The use of carbon-carbon composite materials for pistons in internal combustion engines reduces engine weight, improves engine efficiency, reduces hydrocarbon emissions, potentially eliminate the need for piston rings, and produces a less noisy engine. Because the inherent porosity in carbon-carbon composite materials allows them to soak up oil, good lubrication qualities are imparted to carbon-carbon composite pistons. Additionally, self-lubricating characteristics can be imparted by controlling the graphite content of the composite. Even in the absence of lubrication, carbon-carbon composite materials have no galling tendencies. Therefore, loss of lubricants and/or overheating does not result in catastrophic seizing of the pistons, but only the temporary loss of power due to increased friction.

While performing the same function as a cast iron or aluminum alloy cylinder block, a carbon-carbon composite cylinder block has lower weight and negligible coefficient of thermal expansion (CTE), thereby resulting in higher dimensional stability at extreme operating temperatures.

Thus, combining a low CTE carbon-carbon composite cylinder block or liner, and a carbon-carbon composite- or other material of very low CTE- piston greatly increases the potential for a ringless, reciprocating internal combustion engine which is a significant improvement over the current state-of-the-art, e.g. improved fuel economy, reduced oil consumption, and reduced blow-by.

Even though carbon-carbon composite materials oxidize at operating temperatures above 600 degrees Fahrenheit (F.), coating technology for oxidation protection is sufficiently developed to satisfy requirements for most engine applications. Ceramic coatings, e.g. silicon carbide and silicon nitride, may be used in conjunction with diesel engines. Metallic coatings, e.g. nickel and/or copper, provide very good oxidation protection when applied directly to carbon-carbon composite piston crowns. Nickel also provides catalyticity and copper improves thermal conductivity.

When piston rings are required, carbon-carbon composite or graphite piston rings are capable of operating at higher operating temperatures without becoming as brittle as ceramic rings. In some applications, carbon-carbon composite or graphite rings may be coated with a ceramic coating, e.g. silicon carbide and silicon nitride, to prevent oxidation.

DETAILED DESCRIPTION OF THE INVENTION

Figure 1:
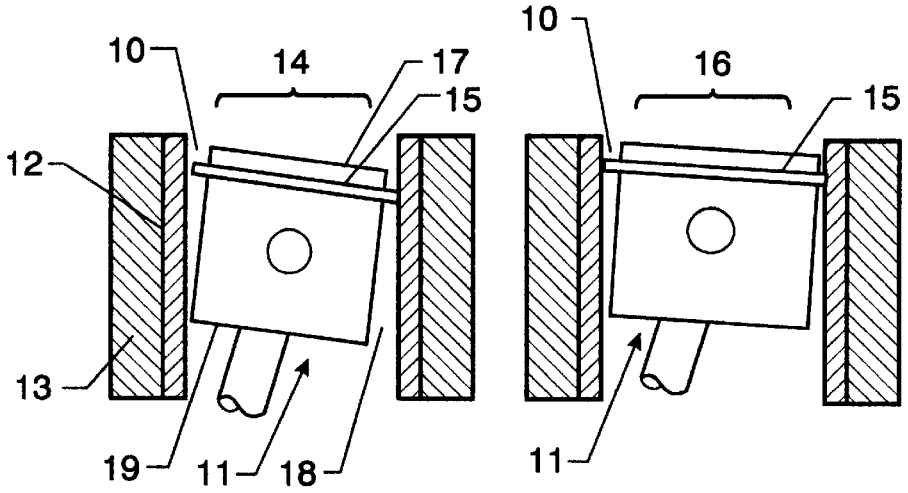
FIG. 1 PRIOR ART
FIG. 1 is an illustration of a prior art engine employing aluminum alloy pistons and an engine block with a cast iron liner.

The inherent disadvantages of current internal combustion engines is depicted in FIG. 1 which depicts the combination of an aluminum alloy piston 11, a cast iron liner 12, and an aluminum alloy cylinder block 13. During cold operation 14, the gap 10 between the cast iron liner 12 and the piston 11 from the piston ring 15 to the crown of the piston 17, called the crevice "volume," becomes a major source of hydrocarbon emission. In addition, the gap 18 formed between the piston ring 15 and the bottom of the piston 19 allows the piston 11 to rock in the cast iron liner 12 which results in noisy operation. During hot operation 16, once the piston 11 has expanded, the gap 10 is less pronounced, but still allows hydrocarbons to escape into the environment. Piston rocking is also less dramatic, i.e, noisy, during hot operation 16.

Carbon-carbon composite materials, as used herein, are well known in the art, and refer to a predominantly carbon matrix material reinforced with predominantly carbon fibers. These materials may be tailored to produce any desired mechanical and physical properties by preferred orientation of the continuous or staple fibers in the composite; and/or by the selection of additives; and/or by thermal treatment of the fibers and matrix before, during, or after fabrication. Carbon-carbon composite materials may be cast or molded, and are machineable. The surface or near-surface material can also be treated and/or coated with oxidation protection or sealing materials, or with catalytic materials such as nickel.

Figure 2:
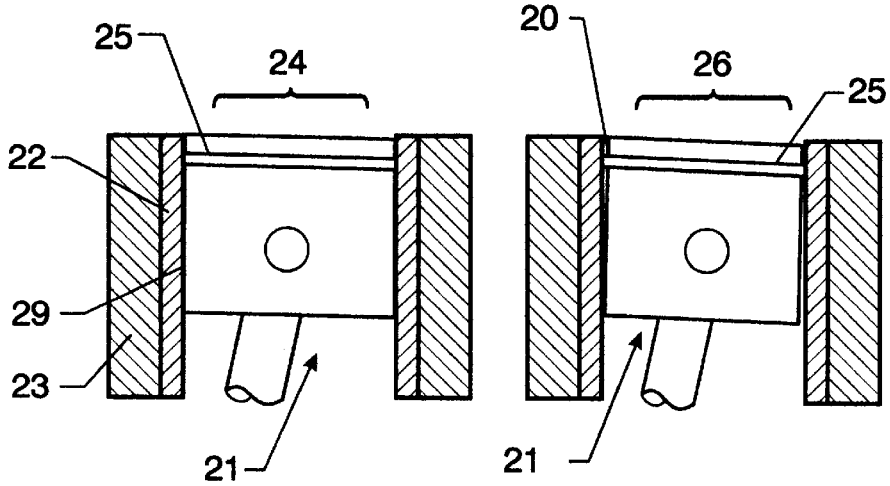
FIG. 2 is an illustration of an engine employing a carbon-carbon composite piston in a cast iron liner.

FIG. 2 illustrates the effect of substituting a carbon-carbon composite piston 21 in an aluminum alloy cylinder block 23 with a cast iron liner 22. Notice that in a very cold environment 24, e.g. minus (–)30 degrees F., a cast iron liner 22 will contract and is likely to clamp down on the piston skirt 29 which could prevent turning over the engine and/or damage the pistons 21. During hot operation 26, the carbon-carbon piston 21 and the cast iron liner 22 work effectively to eliminate any gap 20 above the topmost compression ring 25.

Figure 3:
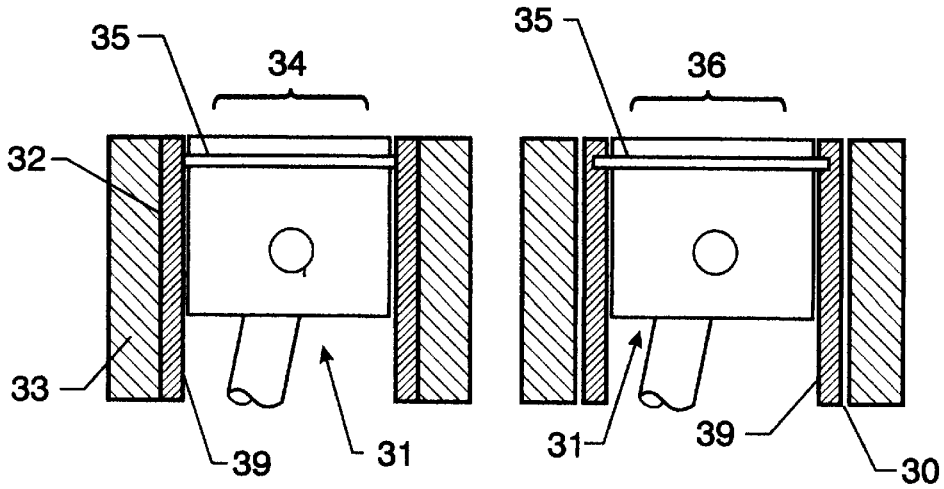
FIG. 3 is an illustration of an engine employing carbon-carbon composite pistons in carbon-carbon composite liners, according to the present invention.
Figure 4:
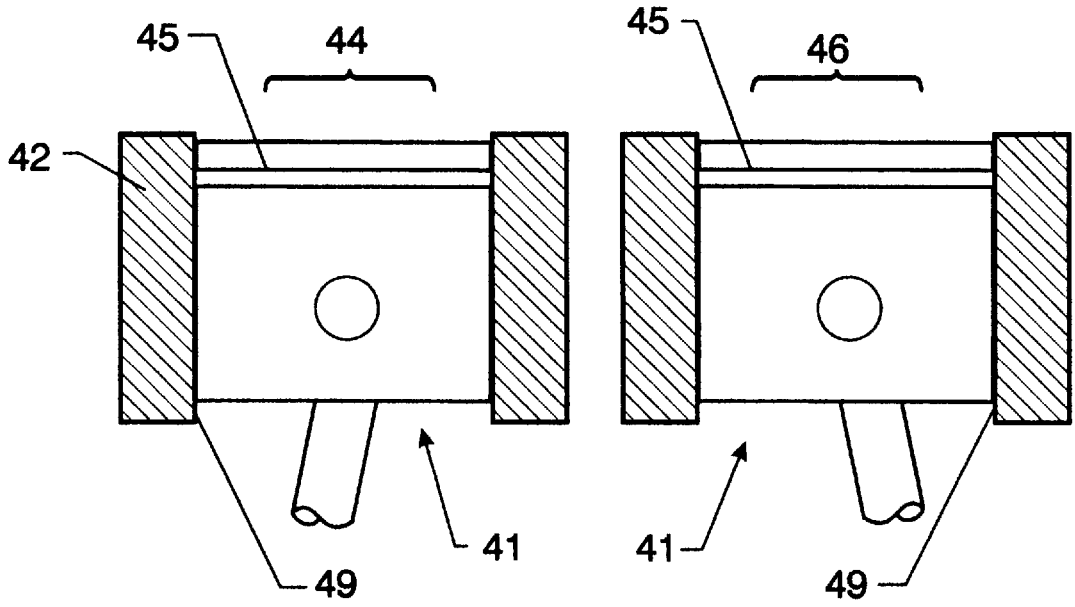
FIG. 4 is an illustration of an engine employing carbon-carbon composite pistons in a carbon-carbon composite engine block, according to the present invention.

Two versions of the claimed invention with piston rings 35, 45 are illustrated in FIGS. 3 and 4 which show a carbon-carbon composite piston 31,41, respectively, in a carbon-carbon composite cylinder liner 32 and a carbon-carbon composite cylinder block 42. During cold 34,44 and hot operation 36,46, there are no gaps between the piston 31,41 and the cylinder wall 39,49. It should be noted, however, that a gap 30 between the carbon-carbon cylinder liner 32 and the aluminum alloy cylinder block 33 may develop due to the differential expansion between the carbon-carbon composite material and the aluminum alloy material.

Figure 5:
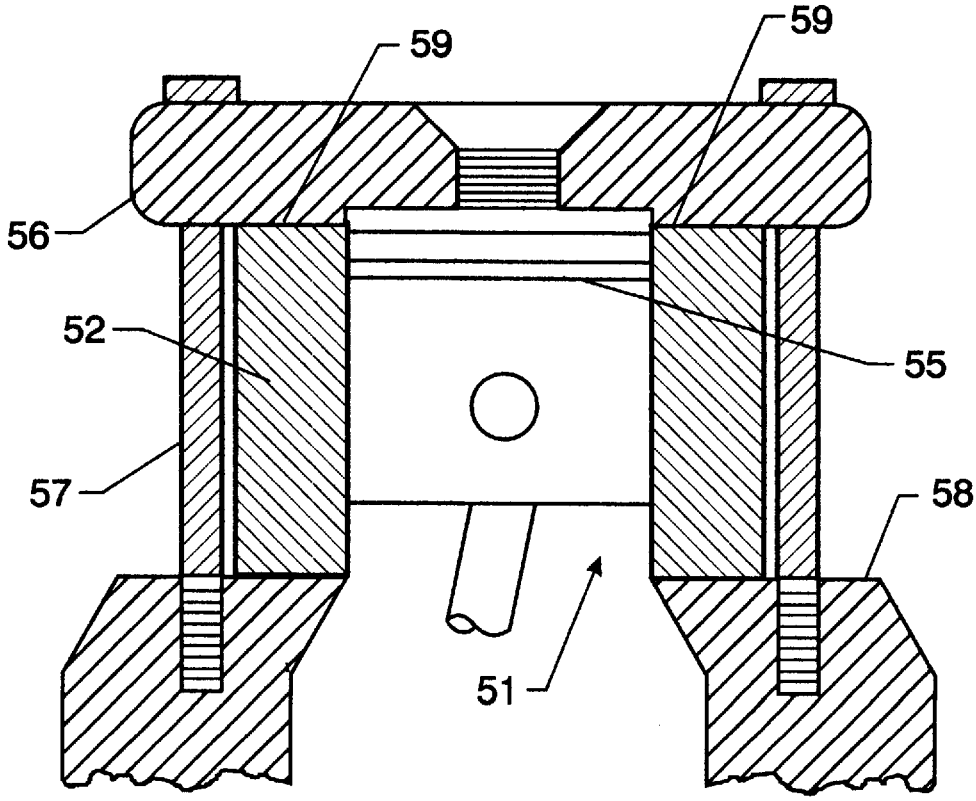
FIG. 5 is an illustration of an engine employing a carbon-carbon composite piston in a carbon-carbon composite tube, or liner, according to the present invention.

FIG. 5 depicts one preferred embodiment of the claimed invention which employs a carbon-carbon composite piston 51 carbon-carbon composite tube 52. The tube 52 is captured between the cylinder head 56 and the crankcase 58 and secured using a plurality of head bolts 57. The piston 51 may be either ringless (not shown) or grooved to include a cast iron, carbon-carbon composite, or graphite piston ring 55.

Figure 6:
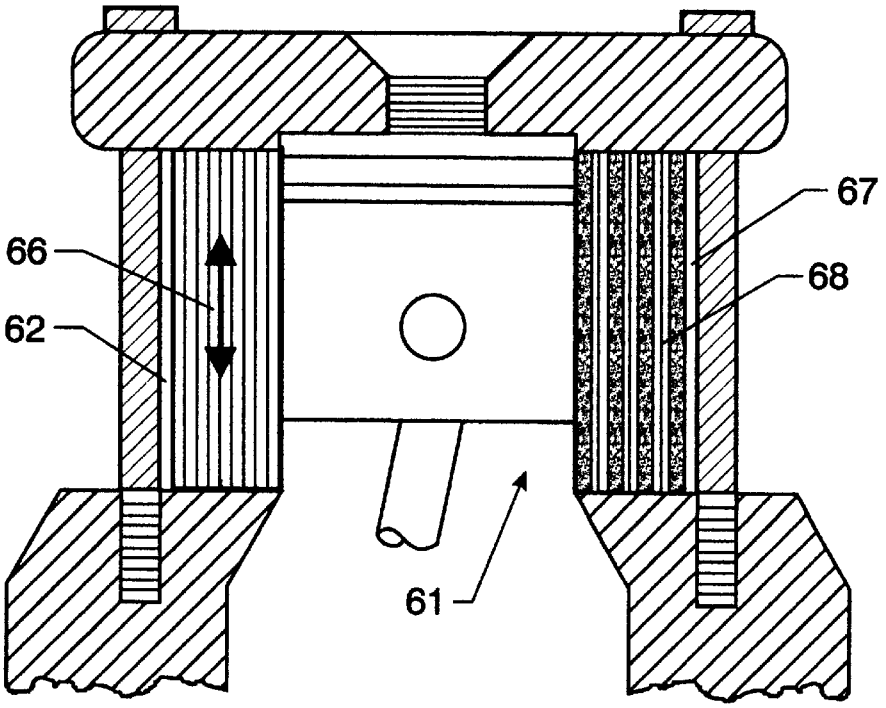
FIG. 6 is an illustration of an engine employing a carbon-carbon composite piston in a carbon-carbon composite tube, or liner, designed to limit radial heat flow, according to the present invention.
Figure 7:
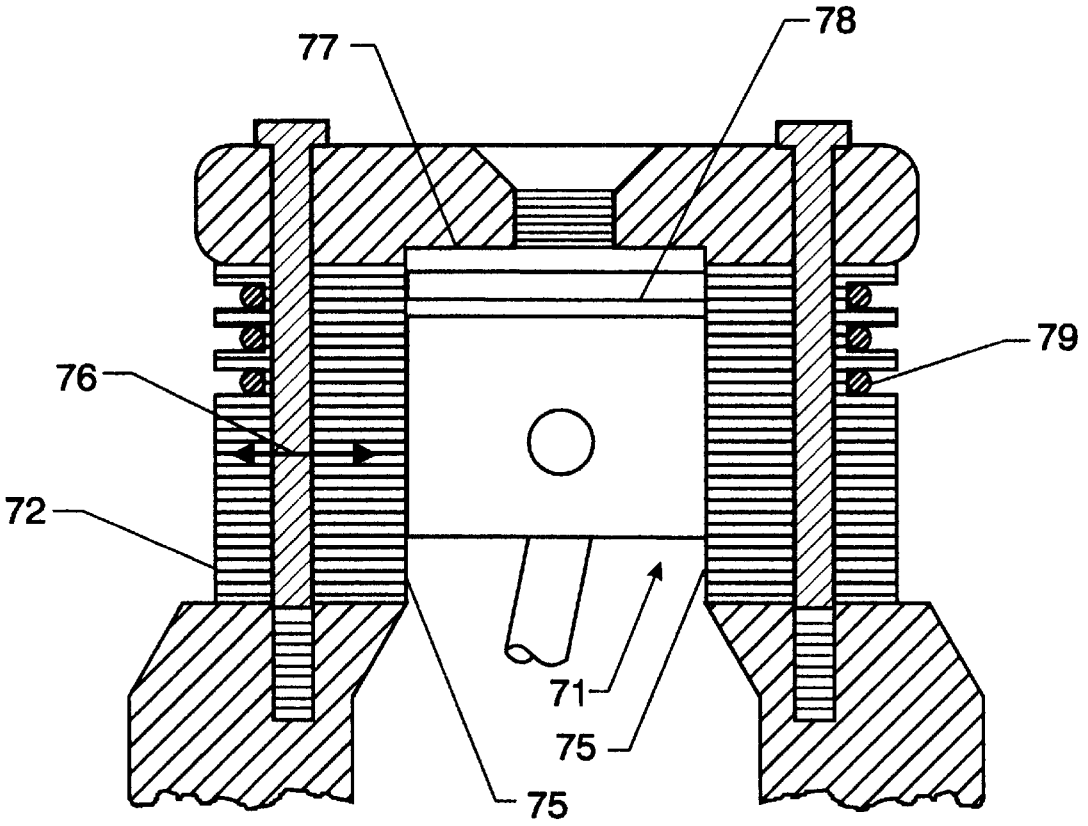
FIG. 7 is an illustration of an engine employing a carbon-carbon composite piston in a carbon-carbon composite tube, or liner, designed to enhance heat flow away from the pistons, according to the present invention.

FIG. 6 illustrates how the carbon-carbon fibers may be oriented to limit radial heat flow from the cylinder tube 62. The carbon fabric or tape laminate 66 comprising the tube 62 should be oriented radially with respect to the tube 62, i.e. the carbon filament axials 68 should be oriented along the same axis as the tube 62 and the carbon filament windings 67 should be wrapped around the circumference of the tube 62. Two-dimensional wrappings may be orthogonal, i.e. at zero and 90 degrees; 30 degrees; ±45 degrees; 60 degrees; or any desired orientation of bias. To facilitate heat flow perpendicular to the cylinder tube 72 axis, FIG. 7 illustrates the preferred orientation of carbon fabric or tape laminate 76 which is perpendicular to the cylinder tube 72 axis.

To enhance heat flow from the piston 71 towards the cylinder wall 75, several plies of carbon fabric or tape 78 may be placed on and parallel to the piston crown 77. To provide hoop stress reinforcement to the cylinder tube 72, a plurality of carbon filament windings 79 may be added.

Figure 8:
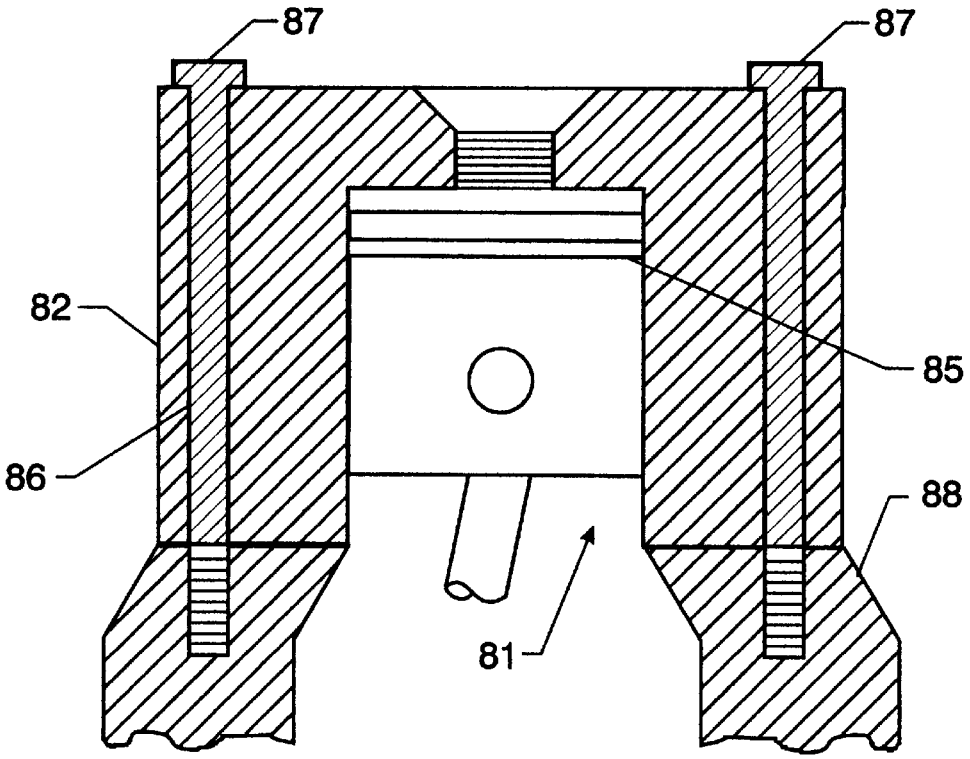
FIG. 8 is an illustration of an engine employing a carbon-carbon composite piston in a carbon-carbon composite jug, according to the present invention.

FIG. 8 depicts another preferred embodiment of the claimed invention wherein a carbon-carbon composite piston 81 reciprocates in a carbon-carbon composite jug 82, which is nothing more than the tube 52 and head 56 from FIG. 5 fabricated as a single unit. The advantage of this version over that of FIG. 5 is that sealing gaskets 59 between the tube 52 and head 56 are not required. The jug 82 is secured to the crankcase 88 by a plurality of head bolts 87. Here again, the piston 81 may be either ringless (not shown) or grooved to include a cast iron, carbon-carbon composite, or graphite piston ring 85. The principles which govern the orientation of carbon fabric and tape laminates shown in FIGS. 6 and 7 for the cylinder tube 52 of FIG. 5 also apply to the jug 82 of FIG. 8.

Figure 9:
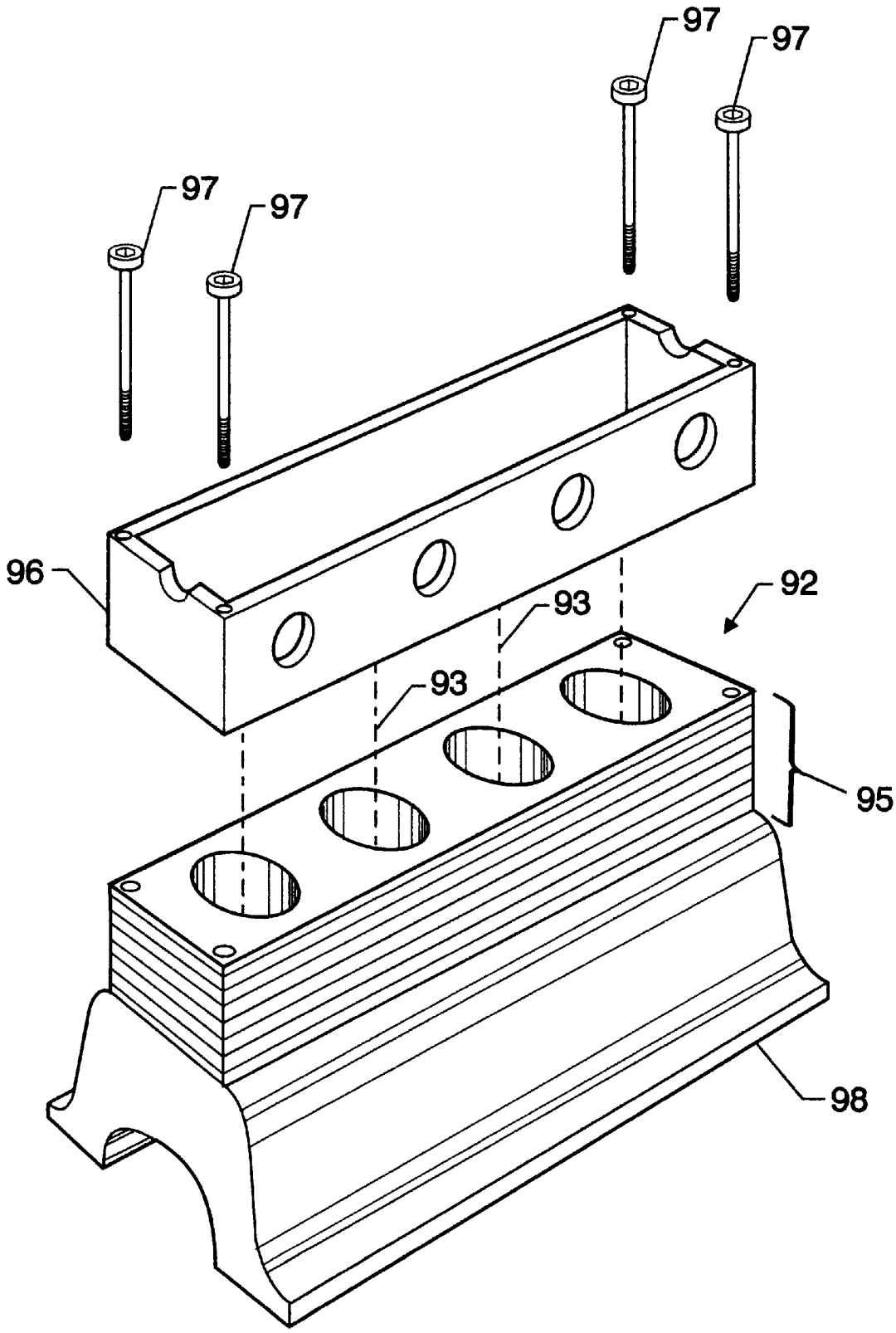
FIG. 9 is an illustration of a carbon-carbon composite cylinder block, according to the present invention.

FIG. 9 depicts the preferred embodiment of a carbon-carbon composite cylinder block 92 to promote heat flow perpendicular to the cylinder bore axis 93. The stacked plies of carbon fabric 95 which make up the cylinder block 92 are captured between the head 96 and the crankcase 98 using a plurality of head bolts 97 to secure the cylinder block 92.

Figure 10:
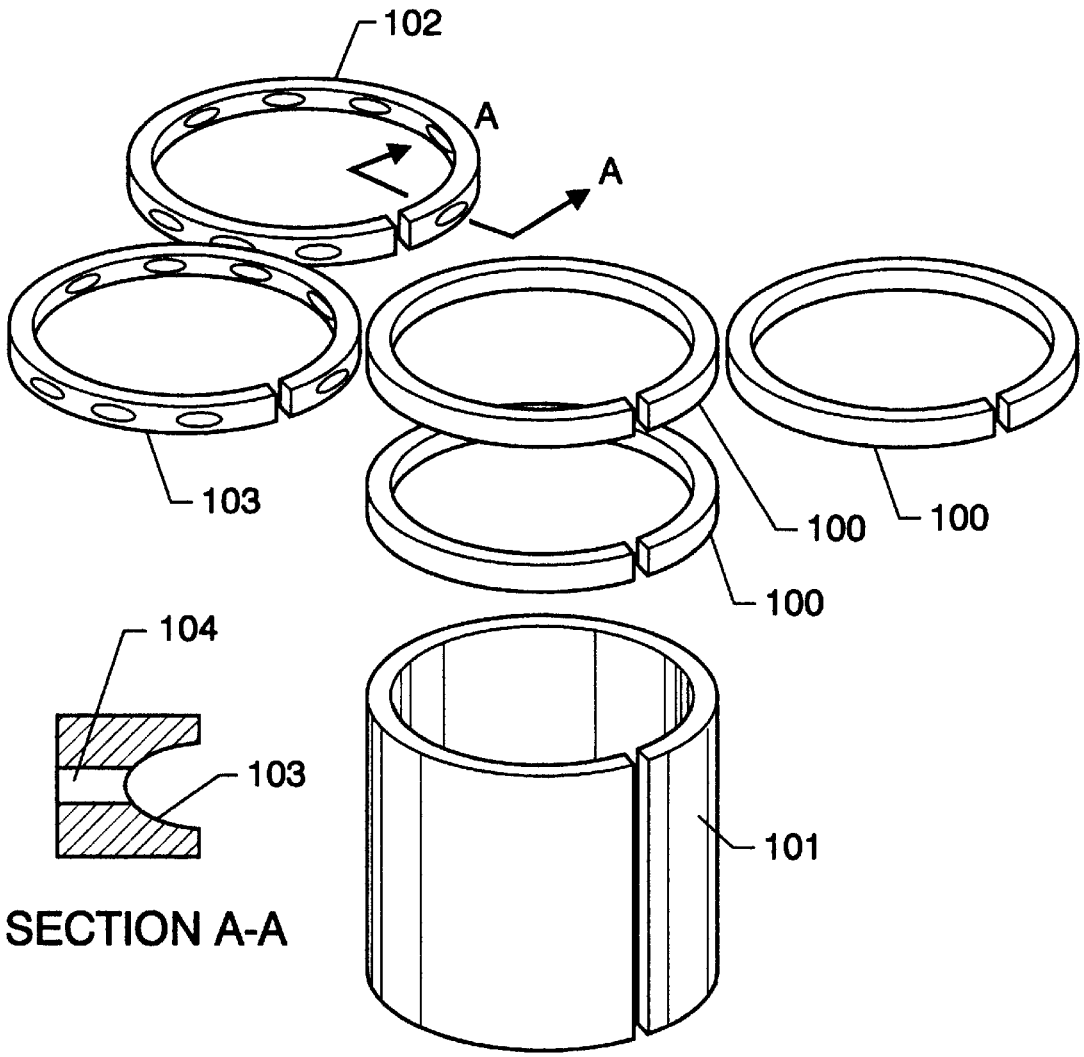
FIG. 10 is an illustration of carbon-carbon composite piston rings, according to the present invention.

FIG. 10 depicts the claimed carbon-carbon composite or graphite piston rings 100. These rings 100 may be fabricated simply by cutting the rings 100 from a cylindrical tube 101 of carbon-carbon composite. Oil control rings 102 which have been machined to include face grooves 103 and oil return holes 104 may also be fabricated from cylindrical tubes 101 of carbon-carbon material; however, the face grooves 103 and oil return holes 104 should be machined in the cylindrical tubes 101 before the oil control rings 102 are cut from the cylindrical tube 101.

The inside diameter of the rings 100, 102, made from carbon-carbon composite materials and/or graphite should be very close to the outside diameter of the piston (not shown) on which they are to be fitted because they cannot be spread open like cast iron or other conventional metals rings.

The invention can be practiced in other manners than are described herein without departing from the spirit and the scope of the appended claims.

What is claimed is:

1. In a reciprocating internal combustion engine wherein a mixture of fuel and air is burned in at least one cylinder containing a piston to form combustion products, and wherein heat produced by burning of the mixture of fuel and air causes the combustion products to expand and force the piston to move within the cylinder, which movement turns a crankshaft, the reciprocating internal combustion engine further comprising at least one piston ring, each piston ring operatively associated with the engine piston, the improvement comprising at least one piston, fabricated from carbon-carbon composite materials, being in operative association with an engine cylinder block fabricated from carbon-carbon composite materials and with at least one piston ring made of carbon-carbon composite materials.

2. The reciprocating internal combustion engine of claim 1, wherein each piston ring is sealed with a ceramic coating for protection against oxidation.

3. The reciprocating internal combustion engine of claim 2, wherein the ceramic coating is silicon carbide.

4. The reciprocating internal combustion engine of claim 2, wherein the ceramic coating is silicon nitride.

5. The reciprocating internal combustion engine of claim 1, wherein each piston ring is sealed with a metal coating for protection against oxidation.

6. The reciprocating internal combustion engine of claim 5, wherein the metal coating is a catalyst.

7. The reciprocating internal combustion engine of claim 6, wherein the catalyst is nickel.

8. The reciprocating internal combustion engine of claim 5, wherein the metal coating is copper.

9. The reciprocating internal combustion engine of claim 1, wherein each piston ring has a face groove and oil return holes machined into it to control oil flow.

* * * * *